US007810300B2

(12) United States Patent
Monti

(10) Patent No.: US 7,810,300 B2
(45) Date of Patent: Oct. 12, 2010

(54) APPARATUS FOR PACKING ARTICLES, IN PARTICULAR STICKPACKS, IN RELATIVE CARTONS

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 13 days.

(21) Appl. No.: 12/253,336

(22) Filed: Oct. 17, 2008

(65) Prior Publication Data

US 2009/0113847 A1 May 7, 2009

(30) Foreign Application Priority Data

Nov. 5, 2007 (IT) ..... BO2007A0735

(51) Int. Cl.
*B65B 35/30* (2006.01)
*B65G 47/26* (2006.01)

(52) U.S. Cl. ..... 53/151; 53/532; 53/541; 198/419.3

(58) Field of Classification Search ..... 53/149, 53/151, 152, 153, 533, 531, 539, 540, 541, 53/247, 250, 251, 252; 198/418, 418.1, 419.3
See application file for complete search history.

(56) References Cited

U.S. PATENT DOCUMENTS 2,917,884 A * 12/1959 Winkler et al. ..... 53/586
3,925,960 A * 12/1975 Saari et al. ..... 53/167
4,181,213 A * 1/1980 Deutschlander et al. .. 198/418.5
4,314,785 A * 2/1982 LaFleur et al. ..... 414/790.3
5,176,244 A * 1/1993 Radzins et al. ..... 198/430
5,884,749 A * 3/1999 Goodman ..... 198/419.3
6,425,476 B2 * 7/2002 Ghiotti et al. ..... 198/426
2005/0144912 A1 * 7/2005 Prakken ..... 53/447

* cited by examiner

*Primary Examiner*—Paul R Durand
(74) *Attorney, Agent, or Firm*—William J. Sapone; Coleman Sudol Sapone P.C.

(57) ABSTRACT

An apparatus is situated downstream of a stickpack manufacturing machine with multiple dropping channels for forming a same number of stickpacks, which are distanced from one another by an interaxial measurement which is more than twice the width of the stickpacks. The apparatus comprises a ring-wound conveyor line, in which two batteries of walled compartments are provided, which batteries are driven independently from each other so that each battery is alternately situated either upstream or downstream; the number of compartments of each is a multiple of the number of dropping channels; the compartments are distanced by a step which is equal to half the interaxial measurement. A robotic handler is provided upstream of the conveyor line, which handler collects the stickpacks exiting from the machine and piles the stickpacks in the compartments of the battery waiting there; first the compartments in odd order, i.e. first, third and so on are filled, then the battery is made to advance by a step in order to fill the compartments in even order, i.e. second, fourth and so on, until all the compartments of the battery have been filled. In a phase relation with a return upstream of the remaining battery, the battery with filled compartments is transferred to a downstream cartoning machine, where a pusher acting transversely to the line transfers at least one pile of stickpacks of a compartment to an adjacent carton, which is carried in synchrony of position and advancement by a relative supply line which is partially flanking the conveyor line.

7 Claims, 5 Drawing Sheets

FIG. 2
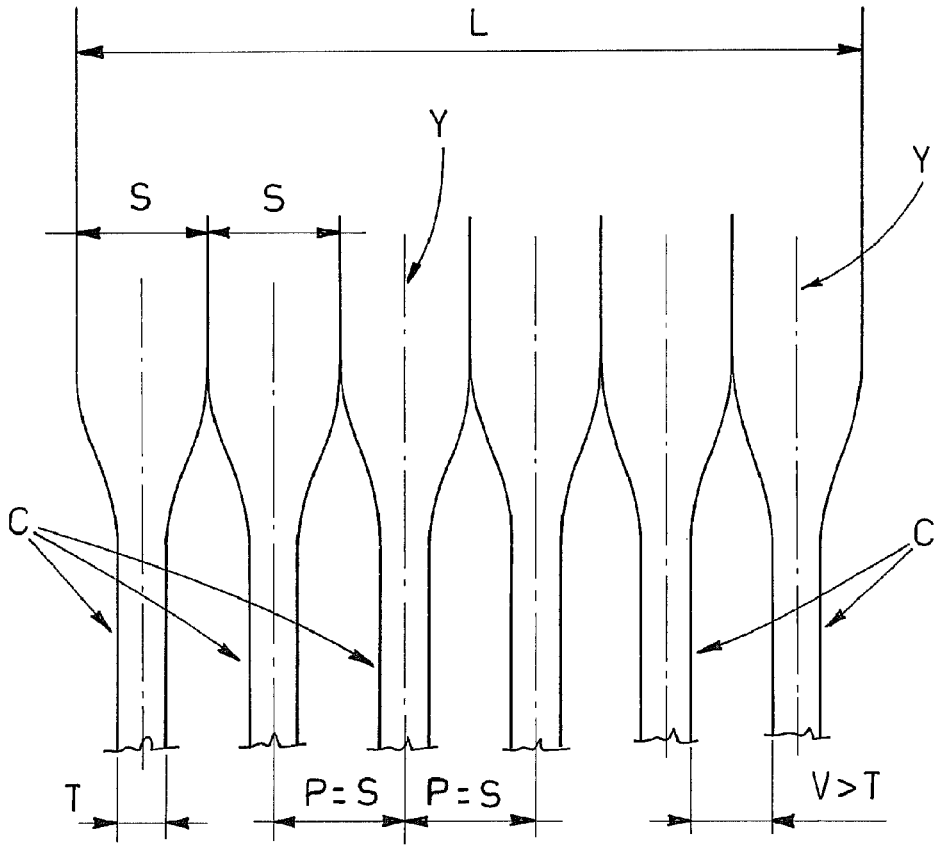
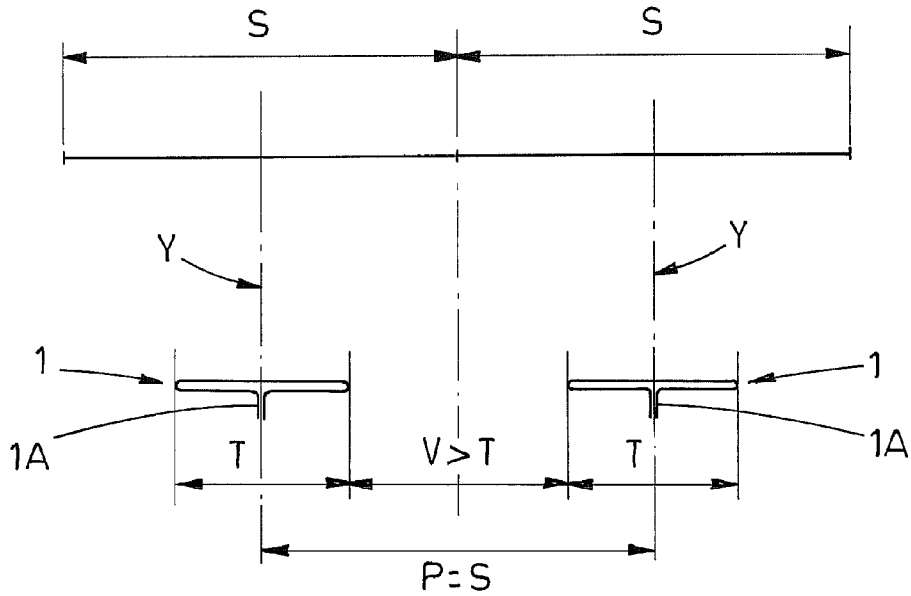
FIG. 3

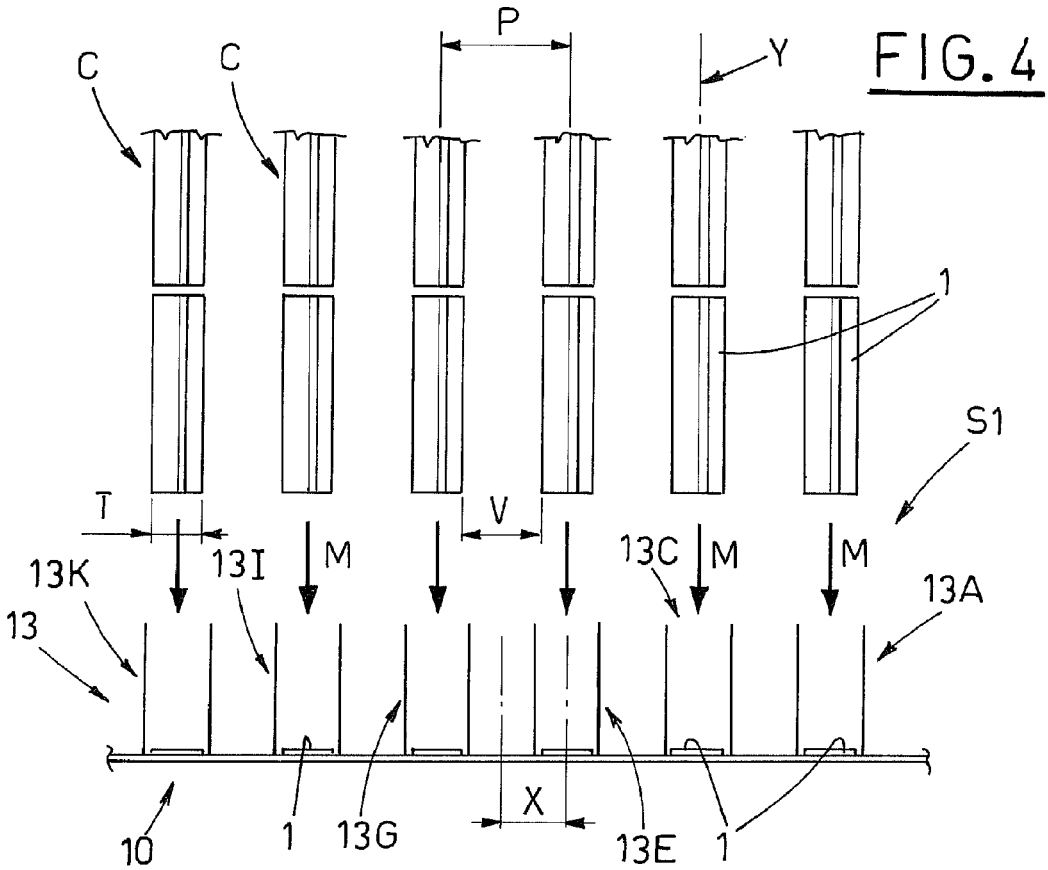
FIG. 4
FIG. 5
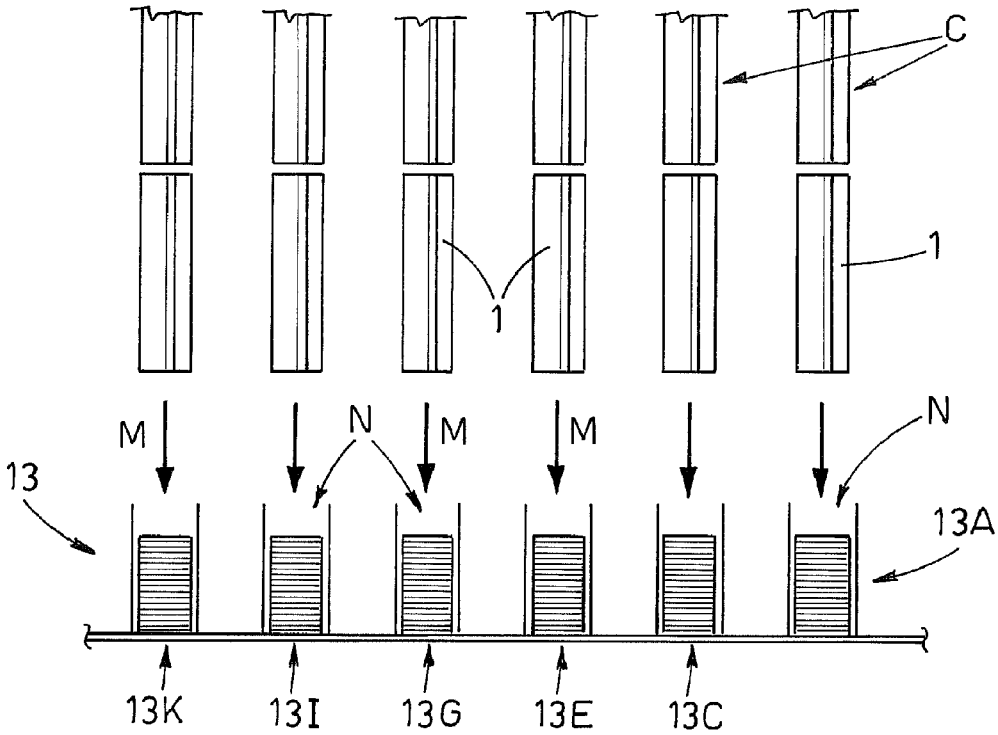

FIG. 6
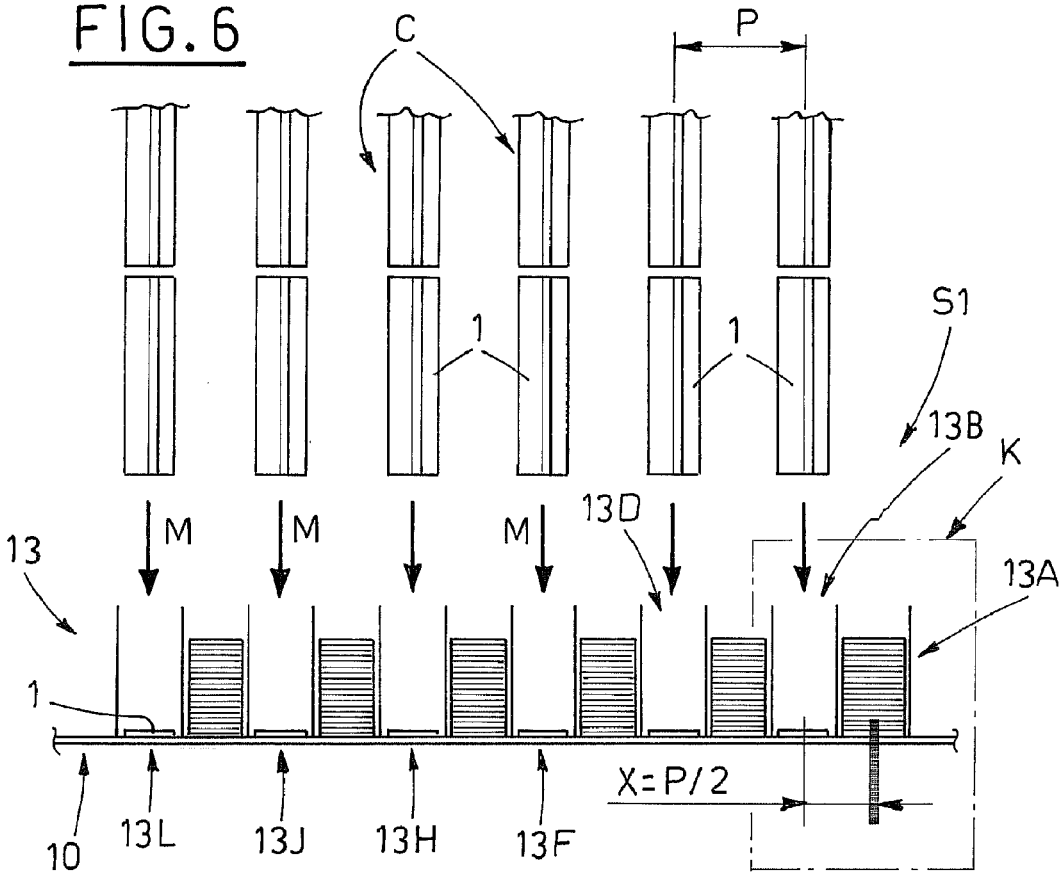
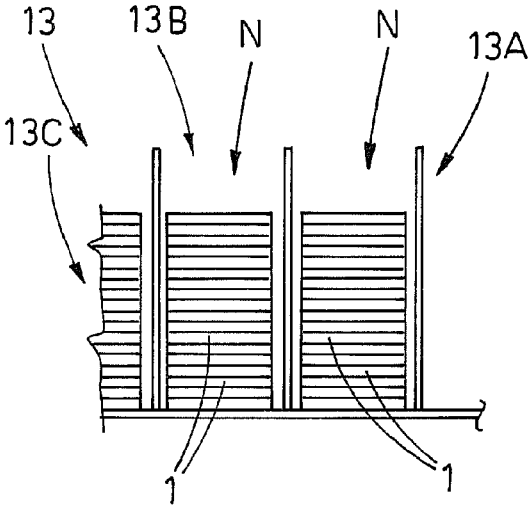
FIG. 7A
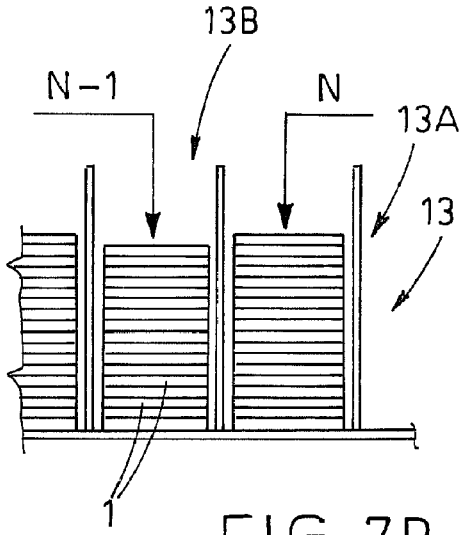
FIG. 7B

APPARATUS FOR PACKING ARTICLES, IN PARTICULAR STICKPACKS, IN RELATIVE CARTONS

BACKGROUND OF THE INVENTION

The invention concerns the technical sector of packaging machines, which are arranged downstream of machines for producing articles in order to receive the articles, order them and insert them into corresponding packagings.

In particular, the invention refers to the packaging of articles constituted by sachets or pouches for granular or liquid products, known in the trade as stickpacks, a predetermined number of which are piled and then placed in relative cartons.

In this technical sector, machines for producing stickpacks are part of the category known as "sachet-filling machines", while the machines for placing them in cartons are known as "cartoning machines".

The most commonly used type of stickpack filling machine is a vertical machine. The taut band which will form the stickpack is unwound from a spool and brought to the upper part of the machine. Suitable cutters divide the band longitudinally into a predetermined number of strips, all having a same width.

Each strip is fed into a relative dropping channel, in which the following are provided, in order:

- folding organs, which roll the strip in the direction of its width so as to form a continuous tubular packaging;
- longitudinal sealing organs, which seal the overlapping edges of the continuous tubular packaging and close the packaging;
- transverse sealing organs, which are activated horizontally in a phase relation with the stepped descent of the continuous tubular packaging, dividing the internal volume of the underlying sealed stickpack from the upper stickpack in formation, which operation defines the bottom of the stickpack;
- pouring organs located above the transverse sealing organs, which project into the continuous tubular packaging and dispense dosed quantities of granular or liquid product into the stickpack being formed;
- cutting organs, which are activated in a phase relation with the descent of the continuous tubular packaging and separate the lowest stickpack from the continuous tubular packaging, which stickpack has been filled with the product and sealed.

The various dropping channels, each being provided with the above-listed organs, are arranged side by side, and distanced by a constant interaxial measurement which is equal to the width of the strips; obviously the same interaxial measurement separates one stickpack from the stickpack adjacent to it, at the exit zone in the lower part of the machine.

The vertically-arranged stickpacks exiting from the machine are collected by handling organs, for example of the "pick and place" type, which have a same number of heads as there are dropping channels, and are arranged with the same interaxial measurement, which handling organs insert the horizontally arranged stickpacks into corresponding queued walled compartments of a conveyor line associated to the cartoning machine which is arranged downstream.

The pick and place cycle is repeated until a predetermined number stickpacks has been placed in each compartment.

The compartments are distanced from each other by the same interaxial measurement as the dropping channels; the walls of each compartment, as is known, are arranged at right angles relative to the direction of advancement of the line and are positioned, in the above-described application, at a slightly lower height than the height of the carton in which the batch of stickpacks will be placed.

Given the same interaxial measurement however, the distance between the walls of each compartment can vary according to the format of the carton which, in turn, will be larger or smaller according to the number of stickpacks it has to contain.

Consequently, there is no control over the position of the stickpacks when they are being placed in the compartments, therefore each batch of stickpacks arranges itself differently, firstly in the relative compartments and subsequently in a relative carton, while remaining within the same overall area.

Thus it is clearly impossible to form an ordered pile of stickpacks and keep their arrangement under control up to the moment when they are placed in the carton; this precludes the following operating modalities:

- placing an ordered pile inside a precisely-sized format of carton, that is, a carton having dimensions only slightly greater than the pile itself;
- placing more than one ordered pile into a precisely-sized carton;
- placing more than one ordered pile into a precisely-sized carton which is provided with separators between one pile and the next.

SUMMARY OF THE INVENTION

The aim of this invention is thus to provide an apparatus for packaging articles, in particular stickpacks, in relative cartons and which can increase the obtainable range of operating performance and, in particular, can allow one or more piles of ordered stickpacks to be placed in a same carton.

A further aim of the invention is to provide an apparatus which delivers the required performance while maintaining constructional solutions which are simple in conception, extremely reliable and no more costly than apparatus of known type.

BRIEF DESCRIPTION OF THE DRAWINGS

The characteristics of the invention will emerge from the following description, which relates to a preferred embodiment of the apparatus of the invention, in accordance with the contents of the claims and with the aid of the appended table of drawings, in which:

FIGS. 2 and 3 show, in different scales, some of the dimensional characteristics regarding the stickpack machine of FIG. 1, which are consequent to the modalities with which the stickpacks are obtained;

FIGS. 4, 5, 6 show a schematic side view of successive moments of the stage during which the piles of stickpacks are formed inside the compartments.

FIG. 7A shows, on an enlarged scale, the detail K of FIG. 6, highlighting a first modality for completing the piles of stickpacks;

FIG. 7B shows a similar view to FIG. 7A, highlighting a second modality for completing the piles of stickpacks;

DESCRIPTION OF THE PREFERRED EMBODIMENTS

In the above-mentioned figures, the reference number 100 refers to the apparatus of the invention in its entirety.

The apparatus 100 is arranged downstream of a stickpack-filling machine B with multiple dropping channels, of a known type and therefore not shown in detail, which produces sachets 1 of the stickpack type.

In the obviously non-limiting example of the figures, the stickpack machine B exhibits six dropping channels C, each of which is provided with organs (not shown) which have already been described in the preamble, and which contemporaneously form and fill six stickpacks 1, which exit from the lower part of the machine at a regular rate.

The stickpacks 1 are particularly suitable for containing single doses of food products, pharmaceuticals or cosmetics in granular, paste or liquid form.

Figure 1:
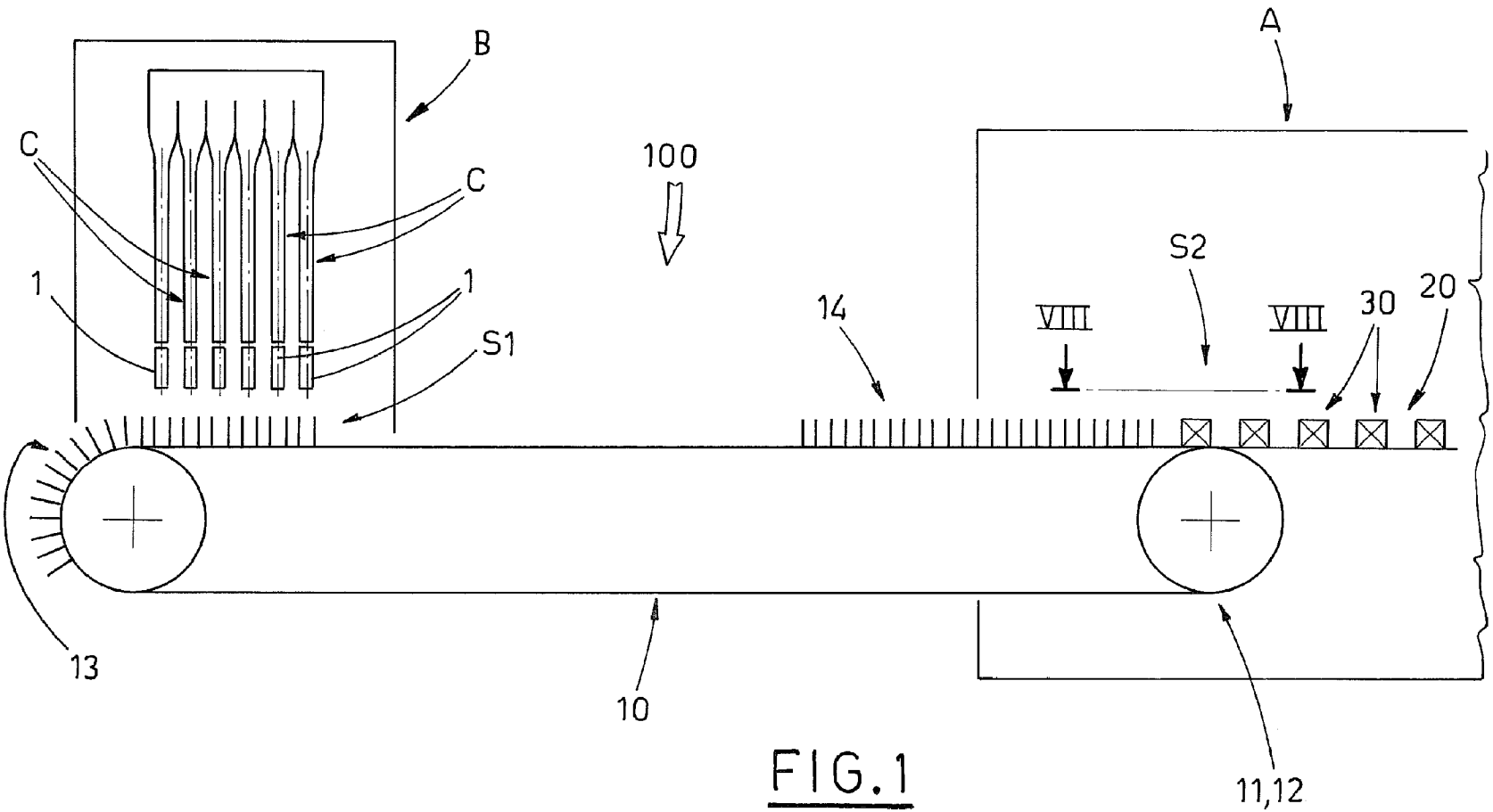
FIG. 1 shows a schematic side view of a stickpack-producing machine and of the apparatus arranged downstream.

The taut band (FIGS. 1 and 2) having a width L, from which the stickpacks I are formed, is unwound from a spool (not shown), enters the upper part of the stickpack machine B, and is divided longitudinally but cutters (not shown) such to provide six strips S of a same length.

The halfway-line axis Y of each strip S coincides with that of the relative dropping channel C.

The interaxial measurement P by which the dropping channels C are distanced is the same as the width of the strips S.

The action of the operating organs present in each dropping channel C first defines a respective downwards-extending, continuous tubular packaging, and then corresponding stickpacks which on one side exhibit a seam 1A determined by an overlap of the edges of the strip S, which overlap is necessary to seal the continuous tubular packaging longitudinally.

The material used for the seam 1A is obviously subtracted from the initial width of the strip S, thus proportionally reducing the final perimeter of the stickpack 1, so that the greatest width T possible for the stickpack in a flat configuration is less than half the width of the strip S when flat (FIG. 3).

Considering the maximum width T of the stickpacks 1 as oriented parallel to the plane on which the dropping channels are arranged side by side, the empty space V separating the stickpacks 1 from other adjacent stickpacks 1 is greater than the maximum width T of the stickpacks 1 (see FIG. 3 again).

This constantly prevailing condition is the foundation upon which the idea for the solution of the invention is based, as will emerge below.

The apparatus 100 comprises a conveyor line 10, substantially of the "synchro-dynamic" type, exhibiting two independent drive organs 11, 12, which are arranged side by side and extend along a shared ring-wound trajectory, to each of which a battery of walled compartments 13, 14 is associated, comprising a number of compartments which is a multiple of the number of dropping channels C; the obviously non-limiting illustrated example exhibits twenty-four compartments 13, 14 for each battery 13, 14, with six dropping channels C.

The compartments 13, 14 of each battery 13, 14 are regularly distanced by a step X which is half the interaxial measurement P of the dropping channels C.

The possibility of arranging the compartments 13, 14 according to the step X thanks to the maximum width T of the stickpacks 1, derives from two further factors:

- the internal distance between the walls of each compartment 13, 14 is defined according to the format being used, such as to be slightly greater than the maximum width T of the stickpacks 1;
- the walls of the compartments are of an appropriately limited thickness.

To reduce the size further, a constructional solution can be adopted, which is shown in the figures and in which each wall, apart from the first and the last of the respective battery, is shared with the relative adjacent compartments.

The conveyor line 10 extends from an upstream loading station S1, located at the zone where the stickpacks 1 exit from the stickpack machine B, to a downstream carton filling station S2, which is provided in a cartoning machine A, which is also of a substantially known type and is therefore shown only schematically.

The independent drive organs 11, 12 alternately position the respective batteries of compartments 13, 14, first at the loading station S1 and subsequently at the carton filling station S2, in an appropriate phase relation and according to predetermined laws of motion, which will be specified below in greater detail.

At the loading station S1, the apparatus 100 provides first operating means which place a predetermined number of stickpacks 1 in each of the compartments 13, 14 of the battery which is in turn present in the station S1, thus forming a pile N.

The first operating means are preferably constituted by a "pick and place" type robotic handler, which is not shown since it is of a known type, having a same number of heads as the number of drop channels C and arranged with the same interaxial measurement P, which simultaneously collects the vertically arranged stickpacks exiting from the channels (six in the example), and places the horizontally arranged stickpacks in corresponding awaiting compartments 13, 14.

In a constructional variant, which is not shown since it is inconsequential for the invention, the first operating means, which are constituted by a robotic handler similar to the one mentioned above, collect the stickpacks 1, and before placing them in the compartments, temporarily release them onto weighing organs which are interposed between the exit zone of the stickpack machine B and the conveyor line 10.

Lastly, the apparatus 100 comprises second operating means at the carton filling station S2, which transfer at least a pile N of stickpacks 1 of a relative compartment 13, 14 to a corresponding carton 30, which is carried, in synchrony of position and advancement, by a relative supply line 90 which is partially adjacent to the conveyor line 10.

The second operating means are constituted for example by a pusher, which is not shown since it is of a known type, the pusher being activated transversely to the conveyor line 10 and the supply line 20; the pusher, according the different operating modalities described herein, is conformed in such a way that it intercepts one or more of the piles N, simultaneously and without interfering with the respective compartments 13, 14.

The number of piles N which can be transferred at a same time must be a submultiple of the number of compartments which constitute one of the batteries; the illustrated examples concern several options, for one, two or three piles N.

A description of the operation of the apparatus 100 now follows.

FIG. 4 shows the loading station S1, where a battery of compartments, for example the battery indicated with reference number 13 has been positioned and halted by the respective drive organs 11, in such a way that the leading compartment 13A is aligned with the dropping channel C which is furthest downstream (on the right in the figure), towards the station S2 for filling cartons.

Since, as specified previously, the step X of the compartments is half the interaxial measurement of the dropping channels C, one compartment out of every two is aligned with the drop channels C; in FIG. 4, in particular, in addition to the first compartment 13A the third 13C, the fifth 13E, the seventh 13G, the ninth 13I and the eleventh 13K are also aligned.

Further, in FIG. 4, the multi-head handler (the action of which is schematically shown by the arrows M) has already placed a stickpack 1 in each of the previously indicated compartments 13, and is about to place a second stickpack 1, which was collected at the exit of the respective dropping channels C.

In FIG. 5 the handler has already completed a predetermined number of operating cycles, and thus a pile N of stickpacks 1 has been formed in the first compartment 13A, and in the other odd-numbered compartments.

Note that the limited play between the walls of the compartment and the pile N enables the pile N to remain perfectly supported and positioned, thus benefiting the subsequent stage of inserting the pile N into a carton, which will be described below.

As soon as the handler has placed the last stickpack 1 of each pile N, the battery of compartments 13 is made to advance by a relative step X, so that after the leading compartment 13A the second compartment 13B, the fourth 13D, the sixth 13F, the eight 13H, the tenth 13J and the twelfth 13L are aligned with the drop channels C.

In FIG. 6, each of these compartments has already received its first stickpack 1 and is ready to receive the others, by means of relative handler operating cycles, until the respective pile N (FIG. 7A) is complete, having reached the same number of stickpacks 1 of piles N as the previously filled compartments.

In a first operational variant, shown in FIG. 7B, in the second 13B, fourth 13D, sixth 13F, eighth 13H, tenth 13J and twelfth compartment 12L, it is possible to form relative piles N-1 having one stickpack 1 fewer than the other piles N; this situation can be used only for cartons containing two, or multiples of two, piles N of stickpacks 1 arranged side by side (see below), so as to obtain an overall odd number (for example twenty-five), which is particularly advantageous from a packaging viewpoint.

In a further operational variant (not illustrated), one of the two piles can be short of more than one stickpack 1, for example in order to leave space for a folded leaflet, or for some other object to be placed in the carton together with the two, or multiples of two, piles of stickpacks 1.

After filling the second to the twelfth compartment 13 inclusive, the drive organs 11 advance the battery until the thirteenth compartment is aligned with the dropping channel C which is furthest downstream (stage not shown) to start forming the piles N in the thirteenth compartment and in the subsequent odd-numbered compartments up to the twenty-third compartment; finally, in a further phase (not shown), the battery of compartments is made to advance by a step X to allow the even-numbered compartments, from the fourteenth to the twenty-fourth, to be filled with the same number, or a smaller number of piles N, depending on the above-mentioned operating variants.

In the time required to complete the stages described so far, the remaining battery of previously filled compartments 14 is at the carton filling station S2.

Figure 8A:
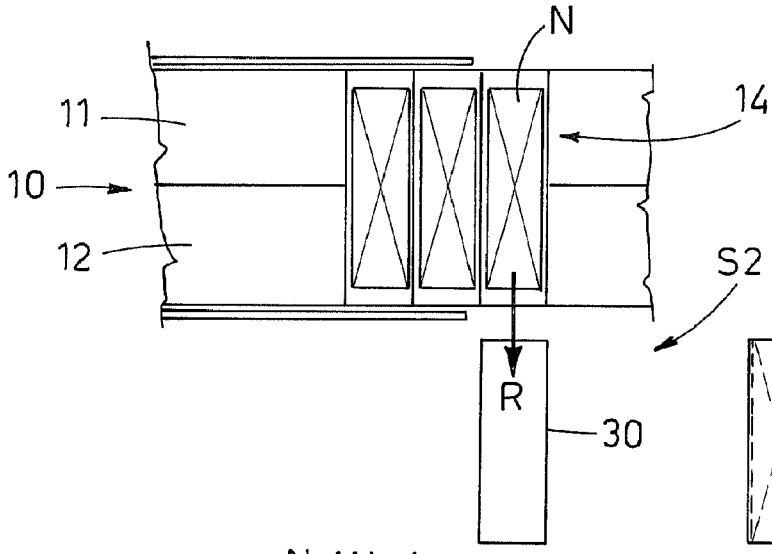
FIGS. 8A, 8B, 8C show three plan views taken along the plan VIII-VIII of FIG. 1, relating to three different modalities for placing the piles of stickpacks in the cartons.

FIG. 8A shows a first operating modality, in which a single pile N of stickpacks 1 is placed in the corresponding adjacent carton 30, which is carried by the respective supply line 20; this modality is obviously always usable, whatever the number of compartments in each battery.

In this case, the drive organs 12 advance the battery of compartments 14 by single steps X, in a phase relation with the activation of the pusher (the action of which is indicated schematically by the arrow R).

Figure 8B:
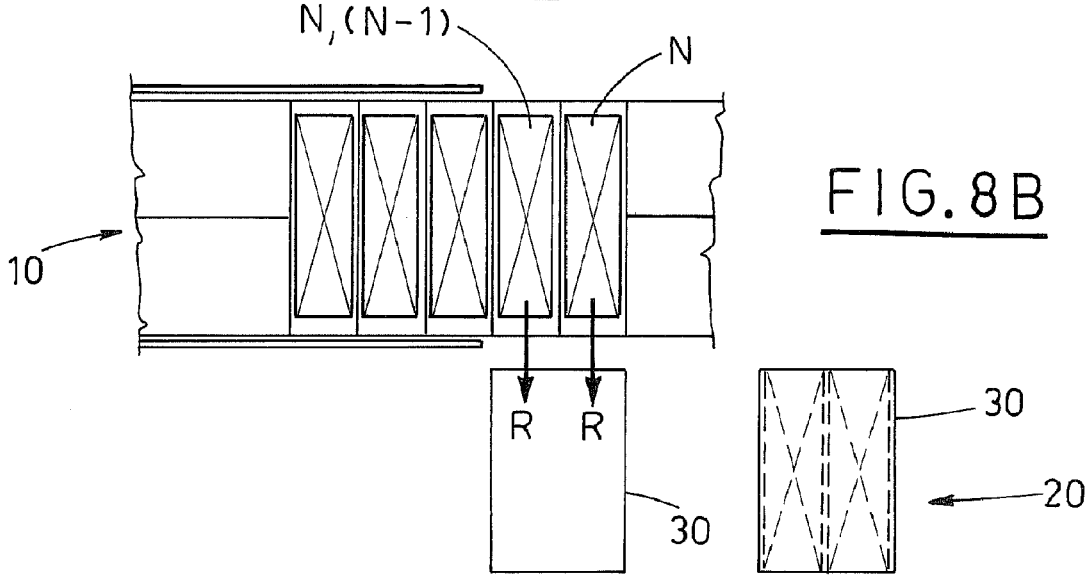

FIG. 8B shows a second operational mode, in which two piles N (one of the two possibly having lower numbers) of stickpacks 1 are inserted in the corresponding adjacent cartons 30; in this embodiment the batteries must consist of an even number of compartments.

In this case, the drive organs 12 advance the batteries of compartments 14 by a distance of two steps X, in a phase relation with the activation of the pusher (the action of which is shown schematically by the arrows R) which is shaped in such a way as to be capable of contemporaneously intercepting the two piles of stickpacks 1 involved, without interfering with the walls of the corresponding compartments.

Figure 8C:
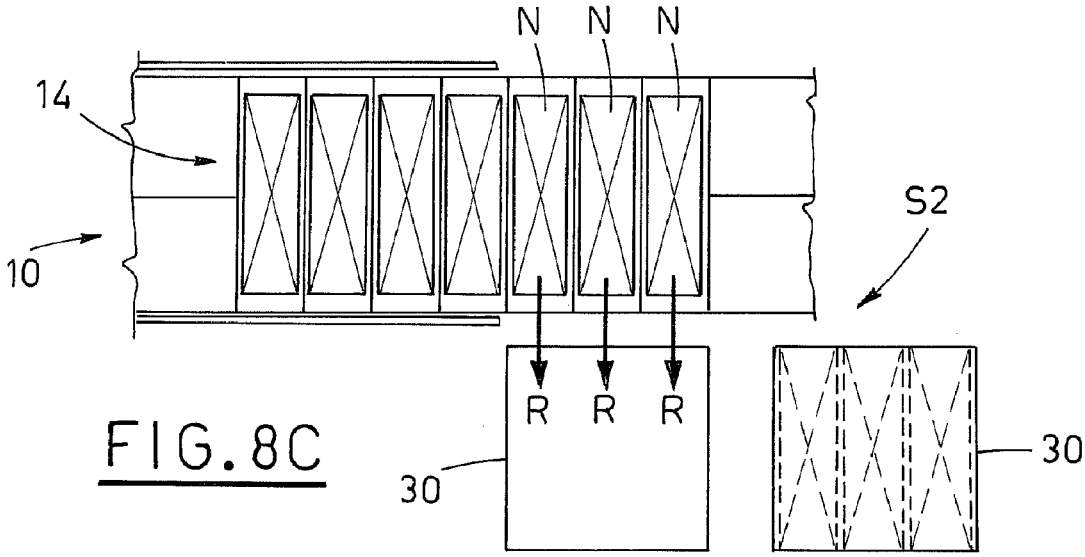

FIG. 8C shows a third operating modality, in which three piles N of stickpacks 1 are placed in the corresponding adjacent carton 30 having even greater dimensions; this modality is utilizable only when the number of compartments in a battery is a multiple of three, as in the example in the figures.

The batteries of compartments 14 are therefore advanced by three steps X, in a phase relation with the activation of the pusher (the action of which is shown schematically by the arrows R), which is shaped so as to be capable of contemporaneously intercepting the three piles of stickpacks 1 involved, in this case too without interfering with the walls of the corresponding compartments.

With reference to the figures, other modalities, which are not shown since they are obvious, would naturally be possible.

The batteries of compartments 13, 14, which are moved by the respective drive organs 11, 12, exchange positions in the stations S1, S2 in an appropriate phase relation, in accordance with the regular production rhythm of the stickpack machine B; to ensure this condition, a traditional general rule is observed, which requires that the productivity of the downstream machine (in this case the cartoning machine A) should be greater than that of the upstream machine (the stickpack machine B), so that all the products exiting from the stickpack machine B will be absorbed, before completion of the operation of filling the compartments positioned at the loading station S1.

In this way, the battery of compartments which is positioned at the downstream station S2 can be repositioned to queue behind the other battery which is at the upstream station S1, before completion of the filling of the compartments at the station S1.

Note that the described operating modalities concerning the possibility of directly placing several stickpacks in the same carton, with the various options depending on the number of dropping channels C and compartments, are in any case an exclusive feature of the apparatus of the invention, which have been achieved thanks to the limited step measurement of the compartments, which means the piles of stickpacks are arranged very close to each other.

This is in fact a fundamental condition so that the piles will sustain each other and that their reciprocal position will remain unaltered during the transitional stage between leaving the compartments and entering the cartons.

The limited space between one pile and another also advantageously allows the dimensions of the cartons to be kept only slightly greater than the dimensional outline of the piles, so that once inside, the piles remain ordered.

The described apparatus is also capable of functioning correctly with cartons provided with separators between one pile and a next, thanks to the precise position in which the piles are kept when being inserted.

The production flexibility obtained by allowing several piles of stickpacks to be placed in a carton make the apparatus of the invention extremely attractive, since the packaging requirements for stickpacks change frequently in relation to different commercial strategies.

The functional advantages of the apparatus, which are evident to the person skilled in the art, have been obtained using an extremely simple technical solution, which derives from noticing the dimension of the empty space between one stickpack and the next in the dropping channels, together with the ingenious arrangement of the half-step-sized compartments.

Thus the apparatus of the invention is less complex than apparatus of the prior art, while providing versatility and higher productivity.

The foregoing is a non-limiting example, therefore any modifications to the form of certain components or to details, which might be introduced for constructional and/or functional reasons, are to be considered as falling within the same protective scope which is defined by the claims below.

What is claimed:

1. An apparatus for packing stickpacks in cartons, the stickpacks being produced by a machine having multiple dropping channels regularly distanced from one another by an interaxial measurement which is more than twice a width of a single stickpack, the apparatus comprising:

a ring-wound conveyor line having at least two batteries of walled compartments, each battery having a number of walled compartments which is a multiple of a number of the dropping channels, the walled compartments being regularly spaced by a distance which is half the interaxial measurement distancing the dropping channels from one another;

means for independently driving each of the batteries of walled compartments along the conveyor line, and for alternately positioning the batteries first at an upstream loading station, and subsequently at a downstream carton-filling station;

first operating means, provided at the loading station and activated in a phase relation with the respective drive means associated with each battery of walled compartments as each battery is situated in turn at the loading station, the first means collecting the stickpacks exiting from the machine and placing the stickpacks in a first set of walled compartments aligned with the drop channels forming a pile of the stickpacks in each compartment of the battery, the pile having a predetermined number of stickpacks, the first operating means then moving the battery forward in half steps to align further sets of walled compartments with the drop channels until the battery is filled;

second operating means, provided in the carton-filling station, which transfer at least one pile of stickpacks from at least one walled compartment of each battery, as each battery having walled compartments with stickpacks located therein is situated in turn at the carton-filling station, into an adjacent carton, located on a relative supply line partially flanking the conveyor line and being synchronously positioned and advanced in coordination therewith.

2. The apparatus of claim 1, wherein a distance between walls of each of the walled compartments is defined according to a size of the stickpacks, being slightly greater than a maximum width of the stickpacks.

3. The apparatus of claim 1, wherein the first operating means are constituted by a robotic handler having a same number of heads as the number of dropping channels, the heads being spatially arranged to correspond with the interaxial measurement, and which heads simultaneously collect vertically arranged stickpacks exiting from the dropping channels and place the stickpacks horizontally-arranged in corresponding queued and waiting walled compartments.

4. The apparatus of claim 1, wherein the second operating means are constituted by a pusher, which is activated transversely to the conveyor line and the supply line, and is shaped to intercept one or more of the piles, simultaneously and without interfering with the respective compartments.

5. The apparatus of claim 1, wherein the second operating means simultaneously intercept a number of piles, the number being a submultiple of the number of walled compartments constituting one of the batteries.

6. The apparatus of claims 1, wherein the walled compartments have limited space between the walls of the compartment and the pile of stickpacks arranged therein.

7. The apparatus of claims 1, wherein each wall of the walled compartments, excepting a first wall and a last wall of a battery, forms a wall of two adjacent compartments.

* * * * *